US007735409B1

(12) United States Patent
Tertin

(10) Patent No.: US 7,735,409 B1
(45) **Date of Patent: *Jun. 15, 2010**

(54) CONVERSION KIT AND METHOD FOR A RUGER® 10/22® SEMI-AUTOMATIC .22 CALIBER RIM FIRE GUN TO SHOOT .17 MACH 2 CARTRIDGES

(75) Inventor: James A. Tertin, Baxter, MN (US)

(73) Assignee: Magnum Research, Inc., Fridley, MN (US)

( * ) Notice: Subject to any disclaimer, the term of this patent is extended or adjusted under 35 U.S.C. 154(b) by 443 days.

This patent is subject to a terminal disclaimer.

(21) Appl. No.: 11/768,566

(22) Filed: Jun. 26, 2007

Related U.S. Application Data

(63) Continuation-in-part of application No. 11/284,372, filed on Nov. 21, 2005, now Pat. No. 7,302,881.

(60) Provisional application No. 60/687,992, filed on Jun. 7, 2005.

(51) Int. Cl.
*F41A 11/02* (2006.01)
*F41A 21/00* (2006.01)

(52) U.S. Cl. ..... 89/128; 42/69.02; 42/77

(58) Field of Classification Search ..... 89/128; 42/69.02, 77
See application file for complete search history.

(56) References Cited

U.S. PATENT DOCUMENTS

| | | | | |
|---|---|---|---|---|
| 4,220,071 | A | 9/1980 | Seiderman | |
| 4,515,064 | A | 5/1985 | Hohrein | |
| H0926 | H | 6/1991 | Mahtook | |
| 5,900,577 | A | 5/1999 | Robinson et al. | |
| 6,513,274 | B1 | 2/2003 | Vastag | |
| 7,121,035 | B2 * | 10/2006 | Greer | 42/77 |
| 7,302,881 | B1 * | 12/2007 | Tertin | 89/128 |

* cited by examiner

*Primary Examiner*—Bret Hayes
(74) *Attorney, Agent, or Firm*—Gerald E. Helget; Nelson R. Capes; Briggs and Morgan, P.A.

(57) ABSTRACT

A conversion kit and method for converting the RUGER® 10/22® semi-automatic .22 caliber rim fire rifle to shoot .17 HM 2 cartridges utilizes the original bolt in the receiver and replaces the bolt operating handle with increased weight to replace the original bolt handle along with a .17 caliber barrel to permit the modified rifle to safely fire, eject and reload the .17 caliber cartridges.

4 Claims, 3 Drawing Sheets

CONVERSION KIT AND METHOD FOR A RUGER® 10/22® SEMI-AUTOMATIC .22 CALIBER RIM FIRE GUN TO SHOOT .17 MACH 2 CARTRIDGES

CROSS-REFERENCE TO RELATED APPLICATIONS

This application is a continuation-in-part of application Ser. No. 11/284,372, filed Nov. 21, 2005, which is a continuation-in-part of application Ser. No. 60/687,992, filed Jun. 7, 2005. The content of these are hereby incorporated by reference in their entirety.

BACKGROUND OF THE INVENTION

The present invention relates to a RUGER® 10/22® semi-automatic .22 caliber rim fire rifle, and more particularly, to a conversion kit and method to convert the RUGER® rifle to shoot .17 caliber cartridges.

.22 caliber long rifle (22 LR) cartridges have been around for many decades and are used in target shooting, small game hunting and varmint hunting. The .22 LR cartridges have a rim fire ignition system versus a center fire system. The .22 LR bullet travels at approximately 1250 feet per second with a 1.9" to 4.7" drop from center at 100 yards. A common rifle action or receiver used for shooting the .22 LR's is the RUGER® 10/22® used in a semi-automatic .22 caliber rim fire carbine rifle.

Recently, a new cartridge has become popular. The .17 caliber Hornady Mach 2 (.17 HM 2) is a 17 grain polymer tipped bullet that is the same length of a .22 LR. However, the .17 HM 2 has significant advantages over the .22 LR in that it travels at approximately 2100 feet per second, or approximately twice the speed of sound, and has only a 0.5 inch center drop at 100 yards. Dedicated rifles with .17 caliber receivers and barrels are available to shoot the .17 caliber cartridges.

Because the .17 HM 2 cartridge is the same length, rim and maximum casing diameters as the .22 LR, rifle enthusiasts have tried to convert their RUGER® 10/22® semi-automatic .22 caliber rim fire rifle to shoot the .17 HM 2 by removing the .22 caliber barrel and retrofitting it with a .17 caliber barrel. However, because the .17 HM 2 has faster peak pressures than the .22 LR, dangerous premature extraction of the casing, case bulging and/or case rupturing have occurred, making this retrofit unsafe and hazardous to shoot.

There is a need for a conversion kit and method for converting the RUGER® 10/22® semi-automatic .22 caliber rim fire rifle to safely shoot .17 HM 2 or .17 caliber cartridges that are nearly twice as fast, more accurate and more destructive.

BRIEF SUMMARY OF THE INVENTION

A conversion kit and method for converting the RUGER® 10/22® semi-automatic .22 caliber rim fire rifle to shoot .17 HM 2 cartridges utilizes the original bolt in the receiver and replaces the bolt operating handle with a weighted bolt operating handle and a .17 caliber barrel to permit the modified rifle to safely fire, eject and reload the .17 caliber cartridges.

A principal object and advantage of the present invention is that the kit and method converts the RUGER® 10/22® rim fire rifle to shoot .17 HM 2 (.17 caliber) cartridges with only changing two parts.

Another object and advantage of the present invention is the conversion of the RUGER® 10/22® to a .17 HM 2 is at a very low cost without the need to purchase a new expensive weighted bolt.

Another object and advantage of the present invention is the conversion of the RUGER® 10/22® (.22 caliber) rifle, which shoots at 1200 feet per second with 1.9" to 4.7" drop at 100 yards, converts to a .17 HM2, which shoots 2100 feet per second with a polymer tipped bullet with a drop of less than 0.5 inches at 100 yards.

Another object and advantage of the present invention is the conversion and method of converting the RUGER® 10/22® caliber rifle to shoot .17 HM 2 cartridges is simple to perform and does not require the aid of a gunsmith.

Another object and advantage of the present invention is the conversion kit for the RUGER® 10/22®.22 caliber rim fire rifle allows it to safely shoot the .17 HM 2 (.17 caliber) rim fire cartridges safely without premature bolt opening.

DETAILED SPECIFICATION

Figure 1:
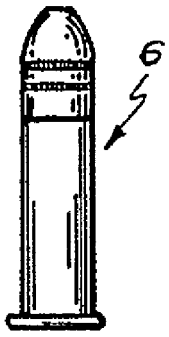
FIG. 1 is a front elevational view of a .22 LR cartridge.
Figure 2:
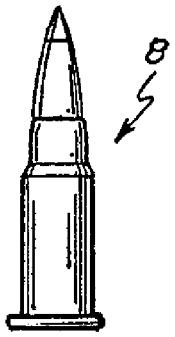
FIG. 2 is an elevational view of a .17 HM 2 or .17 caliber cartridge.
Figure 3:
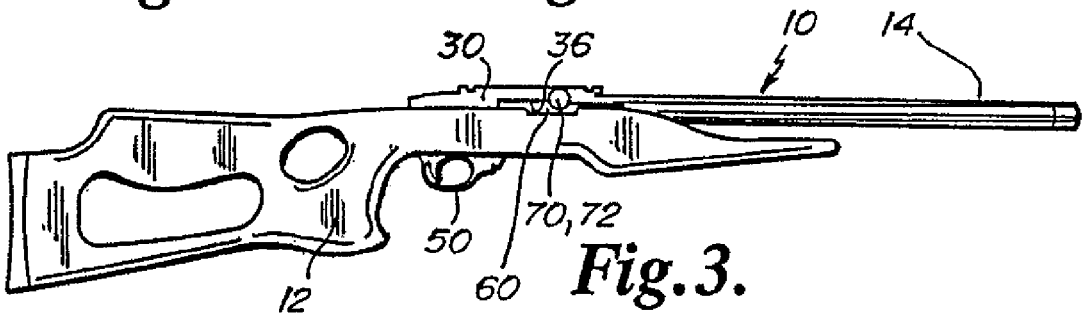
FIG. 3 is a side elevational view of a RUGER® 10/22® semi-automatic .22 caliber rim fire rifle.
Figure 4:
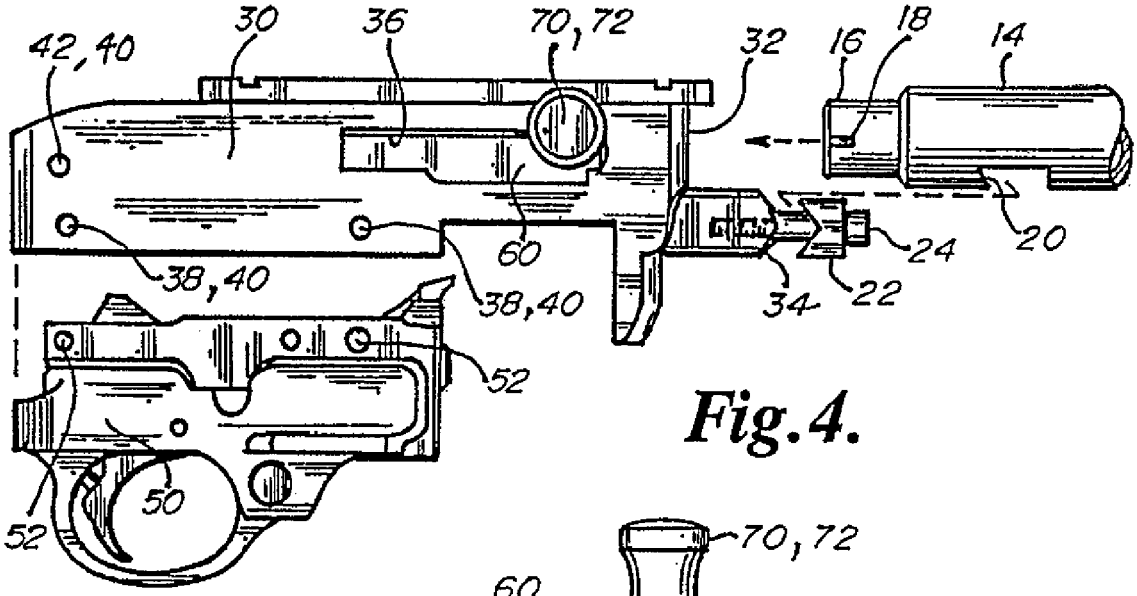
FIG. 4 is an exploded view of the barrel, receiver or action, and trigger guard assembly for the rifle.
Figure 5:
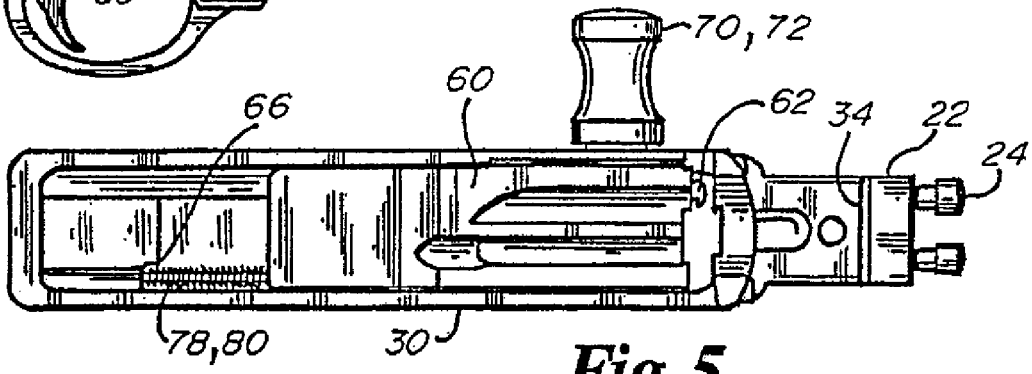
FIG. 5 is a bottom plan view of the receiver of the rifle.
Figure 6:
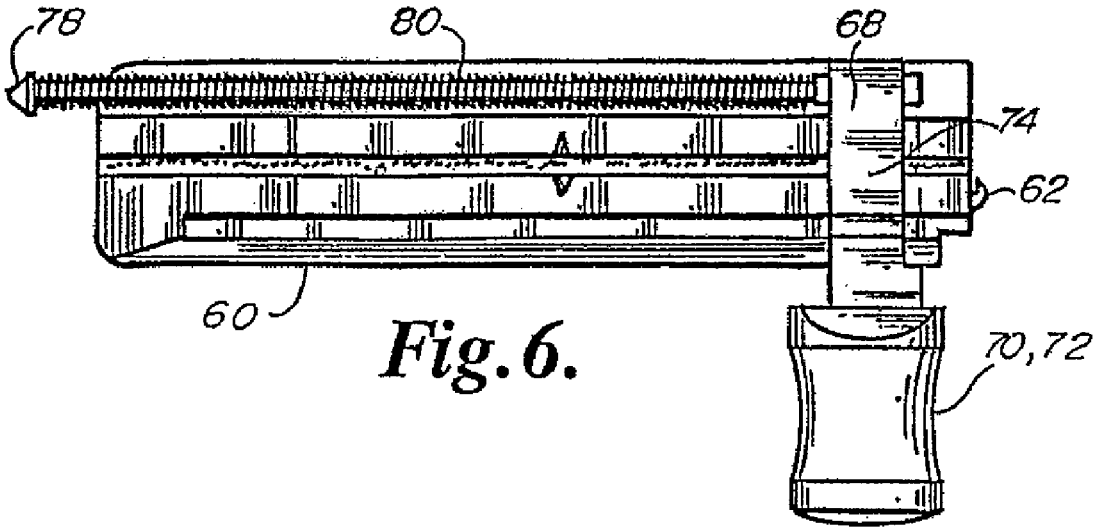
FIG. 6 is a top plan view of the bolt and bolt operating handle removed from the receiver.
Figure 7:
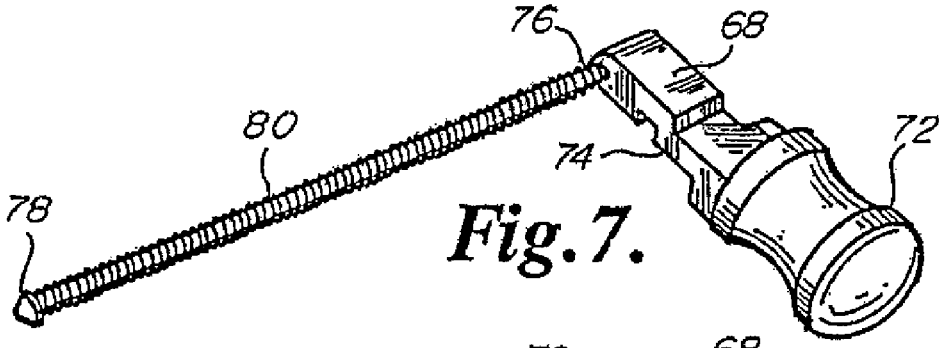
FIG. 7 is a perspective view of the bolt operating handle for a .17 HM 2 cartridge.

Referring to FIGS. 1 and 2, the similar physical characteristics of the .22 caliber long rifle (.22 LR) cartridge 6 and .17 caliber Horniday Mach 2 (.17 HM 2) cartridge 8 may be seen. Respectively, the cartridges 6 and 8 are of the same length. The rim and casing adjacent the rim are of the same diameter. What this means is that the .17 caliber cartridge 8 will fit into the magazine and action of a .22 caliber long rifle RUGER® 10/22® carbine rifle as shown in FIG. 3. However, the .17 caliber casing necks down as it approaches the bullet. This is necessary for proper fitting of the cartridge 8 within the barrel 14 of a .17 caliber rifle barrel. Thus, the differences between the .22 LR cartridge 6 and the .17 cartridge 8 are that they require different barrels and the .17 caliber cartridge 8 has faster peak pressures than the .22 LR cartridge 6.

Referring to FIGS. 3 through 6, the details of a RUGER® 10/22® carbine rifle 10 may be appreciated. The rifle 10 has a stock assembly 12, a barrel 14, a receiver 30, a trigger guard assembly 50, a bolt 60, and a bolt operating handle 68.

More specifically, the barrel 14 has a barrel stub 16 with an adjacent extractor groove 18 to catch and remove the cartridge 6 or 8 from the barrel 14. Underneath the barrel is located a barrel retainer dovetail groove or notch 20. A barrel retainer V-block 22 fits within the notch 20 to hold the barrel in place with the barrel stub 16 securely held within the barrel socket 32 of the receiver by screws 24. The barrel retainer seat 34 is for fixing the barrel retainer V-block 22 thereto by way of the screws 24.

Breach opening 36 is where the cartridges 6 or 8 are ejected from after the rifle is shot. The receiver 30 has cross pins 38 with pass through apertures 40, along with a bolt stop pin 42 with pass through aperture 40, for holding the trigger guard assembly 50 in place with its pass through apertures 52. The bolt stop pin 42 simply stops the rearward movement of bolt 60.

Figure 8:
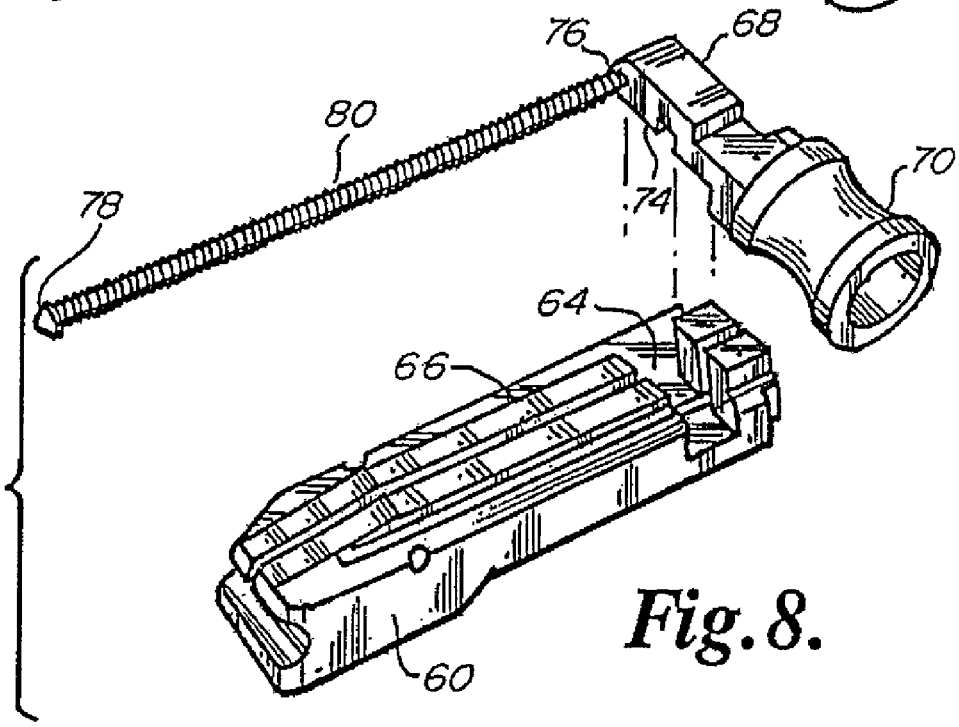
FIG. 8 is an exploded view of the bolt and a bolt operating handle for a .22 caliber cartridge.
Figure 9:
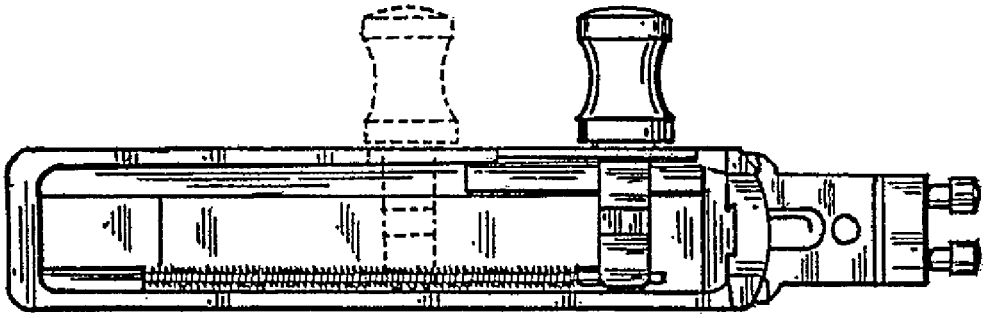
FIG. 9 is a bottom plan view of the receiver or action with the bolt shown in its rearmost position in phantom after the firing of a cartridge or manually pulling the bolt to an open position for ejection.

Referring to FIGS. 5 through 8, the bolt assembly 60 may be appreciated. The bolt for a RUGER® 10/22® approximately weighs 0.404 pounds. The bolt 60 has a biased extractor 62 which interfaces with the extractor groove 18 on barrel 14 to pull the cartridge 6 or 8 out of the barrel stub portion 16 to be ejected through the breach opening of the receiver 30. FIG. 8 shows the bolt handle seat 64 and the guide rod and recoil spring seat 66 which respectfully receives the bolt operating handle 68, guide rod 78 and recoil spring 80.

The details of the bolt operating handle 68 may be viewed in FIGS. 5 through 9. The bolt operating handle 68 of the present invention contemplates two external finger knobs 70 and 72, which are riveted to the handle 68. That is, the stock or factory external finger knob 70 for the RUGER® 10/22® is suitably of anodized aluminum with a hollow knob portion 70 weighing approximately 364 grains or 0.052 pounds. The external finger knob 72 for the .17 caliber must be of such weight to compensate for the pressure of the exploding gases in the bore. Therefore, as ammunition changes, it is necessary to change the weight of the external finger knob 72. Preferably, the external finger knob 72 has a range in weight from approximately 850 grains (0.121 pounds) to approximately 1400 grains (0.2 pounds) and may be of a solid blued steel. By these arrangements, the bolt 60 which weighs 0.404 pounds has the external finger knob 70 for the .22 caliber cartridge for a total weight of approximately 0.456 pounds. The bolt operating handle 68 for the .17 caliber cartridge has an external finger knob 72 at 0.121 pounds to 0.2 pounds plus the weight of the bolt 60 at 0.404 pounds, for a total weight of approximately 0.525 pounds to 0.604 pounds. These weights for the respective .22 and .17 cartridges insure proper and safe operation of the RUGER® 10/22® for firing, ejection and reloading. The difference in weight between the combination bolt 60 and bolt operating handle 68 with the .22 caliber external finger knob 70 and the external finger knob 72 for the .17 caliber is approximately 850 grains to 1400 grains. As stated above, however, this invention contemplates and includes other weights as the pressure of gases in the bore changes with different ammunition.

It may be appreciated that the bolt operating handle 68 on its underside has a bolt seat section 74 for location at the bolt handle seat 64 of the bolt 60. The handle 68 has a guide rod aperture 76 so that the guide rod 78 may be riveted or press fit into place with the recoil spring 80 captured therearound.

Figure 10:
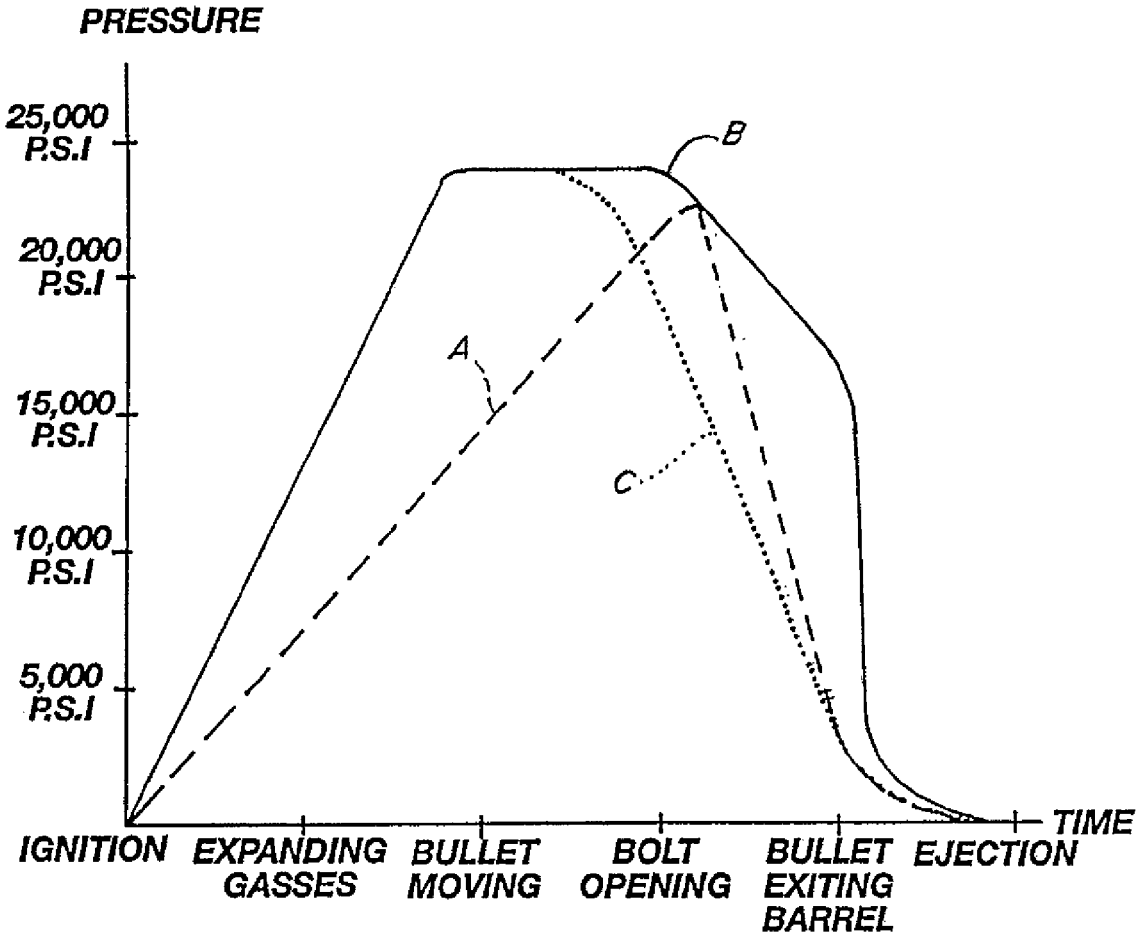
FIG. 10 is a graphical representation of the pressures within the barrel at the receiver along a timeline of operation of the rifle for a RUGER® 10/22® rifle shooting .22 caliber cartridges, unsafely shooting .17 caliber cartridges, and safely shooting .17 caliber cartridges.

Referring to FIG. 10, the safe and unsafe ways to operate a RUGER® 10/22® with .22 caliber cartridges and .17 caliber cartridges are graphically illustrated. Along the horizontal axis are the events of firing a bullet complete through to ejection, while the vertical axis shows the maximum pounds per square inch to approximately 22,000 pounds that develop within the barrel 14 and barrel socket 32. Graph line A in dash lines shows the safe operation for the correct and proper weighted bolt 60 and handle 70 for a .22 LR cartridge. Solid line B shows an unsafe and improper weighted bolt 60 with a bolt handle 68 having a .22 caliber external factory finger knob 70. With the fast peaking pressure, the bolt 60 has a tendency to open early, causing a bulging or explosive result with the casing for the .17 caliber cartridge 8. The solid line and dotted line combination C shows the properly weighted bolt 60, bolt operating handle 68 and weighted external finger knob 72 for the .17 caliber cartridge which will safely fire, eject and reload the .17 caliber cartridge.

The installation of the kit and method of conversion of the RUGER® 10/22® semi-automatic .22 caliber rim fire rifle to shoot .17 HM 2 caliber cartridges may now be appreciated by viewing FIGS. 4 through 9. Initially, the bolt 60 of the .22 caliber version of the carbine rifle 10 is locked in open position by sliding the finger knob 70 rearwardly shown in phantom in FIG. 9. The take-down screw (not shown) which secures the stock assembly 12 to the receiver 30 is loosened. After the receiver 30 is cleaned, the retainer screws 24 are loosened to remove the retainer B block 22 from the barrel retainer seat 34. The barrel 14 is then removed. A .17 caliber barrel 14 has the barrel retainer V block 22 located in the dovetail groove 20 and the screws 24 secure the V block to the barrel retainer seat 34 on receiver 30. By this arrangement, the .17 caliber barrel 14 is secured to the receiver 30.

Next, the stock assembly 12 is removed from the receiver 30 by removal of the take down screw. The cross pins 38 and bolt stop pin 42 are pushed through and removed from the receiver 30. The trigger guard assembly 50 will easily come out of the receiver 30. With the receiver 30 upside down, the bolt 60 is moved to its rearmost position by pulling back on external finger knob 70. The front end of bolt 60 is lifted up and out of the receiver 30 from the opening created by removal of the trigger guard assembly. The bolt-operating handle 68 with the external finger knob 70 for the .22 caliber are separated and set aside.

The bolt operating handle 68 and the new external finger knob 72 for the .17 caliber are seated into the same position on the bolt 60 in the respective bolt handle and guide rod recoil spring seats 64 and 66. The seating arrangement is performed with the knob 72 on the outside of the breach opening 36. The guide rod 78 on the seated bolt-operating handle 68 has its end aligned at the guide rod and recoil spring seat 66. Next, the external finger knob 72, which must be for the .17 caliber, is pulled rearwardly and slight pressure is applied to encourage the bolt 60 to drop into the rearmost part of the receiver 30 to lock the bolt into the front of the receiver 30. The trigger guard assembly 50 is then placed into the receiver 30 and the cross pins 38 and bolt stop pin 42 are inserted into their respective apertures 40. Next, the stock assembly 12 is secured to the receiver 30 through the takedown screw or stock bolt.

The RUGER® 10/22® semi-automatic .22 caliber rim fire rifle is now safely ready for shooting and will follow the pressure and time curve according to solid and dotted line C.

It is intended that the above description and accompanying drawings are to be interpreted as illustrative only and not limiting. Changes in the detail and structure may be made without departing from the spirit of the invention as defined in the appended claims.

The invention claimed is:

1. A conversion kit for a RUGER® 10/22® semi-automatic .22 caliber rim fire firearm capable of shooting .22 caliber long rifle cartridges to shoot 17 Mach 2 (.17 caliber) cartridges that are nearly twice as fast and more accurate at longer ranges than .22 caliber long rifle cartridges, wherein the firearm has a bolt and a bolt operating handle of sufficient weight to safely fire, eject and reload a .22 caliber long rifle cartridge, and wherein the rifle has been converted to replace the standard barrel with a .17 caliber barrel for shooting 17 Mach 2 cartridges but will not safely fire, eject and reload the .17 caliber cartridges, comprising:

(a) a second bolt-operating handle with increased weight to replace the first bolt operating handle to safely fire, eject and reload the .17 caliber cartridges; and (b) and external finger knob with increased weight of approximately 850 grains to approximately 1400 grains to the bolt.

2. A conversion kit for a RUGER® 10/22® semi-automatic .22 caliber rim fire firearm capable of shooting .22 caliber long rifle cartridges to shoot 17 Mach 2 .17 caliber cartridges that are nearly twice as fast and more accurate at longer ranges than .22 caliber long rifle cartridges, wherein the firearm has a bolt and a bolt operating handle of sufficient weight to safely fire, eject and reload a .22 caliber long rifle cartridge, but will not safely fire, eject and reload the .17 caliber cartridges, comprising:

(a) a second bolt operating handle with increased weight to replace the first bolt operating handle to safely fire, eject and reload the .17 caliber cartridges;

(b) a .17 caliber barrel for shooting 17 Mach 2 cartridges; and (c) an external finger knob with increased weight of approximately 850 grains to 1400 grains to the bolt.

3. A conversion kit for a RUGER® 10/22® semi-automatic .22 caliber rim fire firearm capable of shooting .22 caliber long rifle cartridges to shoot 17 Mach 2 .17 caliber cartridges that are nearly twice as fast and more accurate at longer ranges than .22 caliber long rifle cartridges, wherein the firearm has a bolt and a bolt operating handle of sufficient weight to safely fire, eject and reload a .22 caliber long rifle cartridge, but will not safely fire, eject and reload the .17 caliber cartridges, comprising:

(a) a .17 caliber barrel for shooting 17 Mach 2 cartridges; and (b) a second bolt-operating handle with an external finger knob with increased weight to add an additional 850 grains to 1400 grains of weight to the bolt to replace the first bolt operating handle to safely fire, eject and reload the .17 caliber cartridges.

4. A method of converting a RUGER® 10/22® semi-automatic .22 caliber rim fire firearm capable of shooting .22 caliber cartridges to shoot 17 Mach 2 caliber cartridges that are nearly twice as fast and more accurate at longer ranges than .22 caliber long rifle cartridges, the method comprising:

(a) removing the .22 caliber barrel from the firearm receiver;

(b) securing a .17 caliber 17 Mach 2 cartridge barrel to the firearm receiver;

(c) removing the trigger guard assembly from the receiver;

(d) removing the bolt and bolt operating handle from inside the receiver;

(e) removing the bolt operating handle and external finger knob from the bolt;

(f) installing a second bolt operating handle and external finger knob with increased weight of approximately 850 grains to 1400 grains on the bolt;

(g) installing the bolt inside the receiver; and (h) installing the trigger guard assembly into the receiver.

* * * * *